US005802991A

United States Patent [19]

Brown et al.

[11] Patent Number: 5,802,991

[45] Date of Patent: Sep. 8, 1998

[54] TRANSACTION DRAWER ASSEMBLY AND METHOD

[75] Inventors: Michael E. Brown, Mason; Michael J. Craven, Sycamore Township, both of Ohio

[73] Assignee: E. F. Bavis & Associates, Inc., Maineville, Ohio

[21] Appl. No.: 880,052

[22] Filed: Jun. 20, 1997

Related U.S. Application Data

[63] Continuation of Ser. No. 582,094, Jan. 2, 1996, abandoned.

[51] Int. Cl.[6] ..... E06B 7/32

[52] U.S. Cl. ..... 109/19; 109/66; 232/43.1

[58] Field of Search ..... 109/5, 10, 11, 109/15, 16, 19, 66; 232/43.1–43.4, 44

[56] References Cited

U.S. PATENT DOCUMENTS

| | | | |
|---|---|---|---|
| Re. 32,456 | 7/1987 | Ishii | 200/61.61 |
| 535,198 | 3/1895 | Dobson . | |
| 791,536 | 6/1905 | Cleal . | |
| 1,026,762 | 5/1912 | Muzzy . | |
| 1,068,760 | 7/1913 | Godefroid . | |
| 1,654,045 | 12/1927 | Howell . | |
| 2,118,382 | 5/1938 | Meilink | 109/1 |
| 2,607,526 | 8/1952 | Boyden et al. | 235/22 |
| 2,730,053 | 1/1956 | Ellithorpe | 109/19 |
| 2,883,104 | 4/1959 | Kinter | 235/22 |
| 2,949,870 | 8/1960 | Graber | 109/19 |
| 3,059,840 | 10/1962 | Graber et al. | 109/19 X |
| 3,077,243 | 2/1963 | Buros | 109/19 X |
| 3,145,918 | 8/1964 | Higgins et al. | 109/19 X |
| 3,237,853 | 3/1966 | Grosswiller, Jr. | 232/43.3 |
| 3,390,833 | 7/1968 | Harris | 109/19 X |
| 3,615,050 | 10/1971 | Deaton et al. | 232/43.3 |
| 4,031,357 | 6/1977 | Brand | 235/12 |
| 4,135,658 | 1/1979 | Hagberg | 232/43.1 |
| 4,176,610 | 12/1979 | Markham et al. | 109/66 X |
| 4,190,004 | 2/1980 | Richardson | 109/19 |
| 4,393,789 | 7/1983 | Glotfelter | 109/19 |
| 4,436,989 | 3/1984 | Schuldt | 235/22 |
| 4,517,901 | 5/1985 | Clark | 109/19 |
| 4,640,200 | 2/1987 | Richardson | 109/19 |
| 5,205,224 | 4/1993 | Durst | 109/19 |
| 5,511,494 | 4/1996 | Scott | 109/19 |
| 5,537,734 | 7/1996 | Belka | 29/705 |

FOREIGN PATENT DOCUMENTS

| | | | |
|---|---|---|---|
| 2558284 | 7/1985 | France | 109/19 |

*Primary Examiner*—Suzanne Dino
*Attorney, Agent, or Firm*—Dinsmore & Shohl LLP

[57] ABSTRACT

An improved transactional drawer and method for reciprocating the drawer relative to its housing and opening the customer door in a sequential multi-stage manner. The drawer assembly preferably comprises a housing, a drawer and a customer door, wherein the drawer is free to reciprocate relative to the housing by interaction of a rail and corresponding slot guide track arrangement. A low powered reversible power source selectively reciprocates the drawer relative to the housing, a cam actuator, and the interaction of a cam actuator and follower arrangement mechanically moves the customer door between pre-determined opened and closed positions in a sequential multi-stage manner in response to the reciprocation of the drawer. A seal member is located between the customer door and at least a portion of the front edge of the housing when the door is in its closed position, and one stage of the sequential multi-stage mechanical movement of the door is provided in a direction substantially only normal to the seal member to minimize stresses on the seal member during opening and closing procedures.

26 Claims, 4 Drawing Sheets

TRANSACTION DRAWER ASSEMBLY AND METHOD

This is a continuation of application Ser. No. 08/582,094, filed Jan. 2, 1996 now abandoned.

FIELD OF INVENTION

This invention relates generally to transactional drawers and methods of moving items from one side of a barrier wall to another; and, more particularly, to a transactional drawer assembly and method for reciprocating the drawer between several operating positions and mechanically moving the drawer door between opened and closed positions in a sequential multi-stage manner to minimize wear and tear on the door seal.

BACKGROUND OF THE INVENTION

The need for transacting business from inside a building or other structure, with people on the outside of the building, arises in a variety of situations. Banks, gas stations, fast food restaurants, which are ubiquitous in today's society, all transact business with customers who either drive up or walk up to their building but do not necessarily enter it. Transactional drawers are commonly used to facilitate such "drive through" type of business, and drive up windows at banks and fast food restaurants are the most common example of business settings where transactional drawers are used.

For example, a customer can drive up to a bank teller's window and, normally with the aid of communication equipment such as speakers and microphones, the customer can communicate with personnel inside the bank. Upon communicating the nature of the transaction to take place, the customer can place money, packages or the like into an extended and open drawer which can be mechanically retrieved. After the drawer is retrieved, the deposited items can be removed from the drawer by the teller in the comfort and safety of the building. Likewise, items within the building can be placed in the drawer for reciprocating and delivery to a waiting customer. Transactional drawers can also provide security for businesses and their employees because potentially dangerous transactions can be carried out from the relative security of the building, without direct contact with the customers.

Therefore, transactional drawers can provide safety, security and convenience for business establishments, their employees, and their customers as well. However, prior transactional drawers have been plagued with a series of mechanical problems, physical limitations, and potential safety concerns. In the past, large AC current motors have been used to reciprocate drawers into and out of drawer housings or drawer mounting frames attached within a wall. The use of larger AC motors, however, created problems because they can exert significant force on the drawer, typically through a series of pulleys, belts, drive chains and the like. The force exerted on some prior positive drive transactional drawers was large enough that the limit of travel had to be controlled by electrical means, i.e., electronic limiting switches.

Another means of limiting travel in some prior drawers included a "V" belt arrangement, which would slip in its mating sheave to thereby limit driving forces. When a "V" belt arrangement was used, resulting deflection in the ball bearing guides and other structures generally required excessive forces to be preloaded into the system, causing premature wear and/or failure of the bearing guides, gear boxes and other operative structures. Such requirements add to the cost, complexity and inherent reliability problems of the system. Problems have arisen when, for instance, a car pulls too close to a drive through window, and the drawer is extended into contact with the car causing damage to the automobile and the drawer. Safety limitations and physical restrictions of travel have been a reoccurring problem in some previously available transactional drawers.

High powered AC motors used in many prior transactional drawer assemblies required expensive and complicated electronic limiting devices. Particularly, as the drawer reached its fully extended or fully retracted positions, there was a need for an electronic signal to be communicated to the motor in order to cause the motor to shut down. Even after the motor had discontinued operating, there was sometimes movement of the drawer as it "coasted" to a stop at either its fully retracted or fully extended position. Problems have also arisen in the past when the drawer was powered outwardly and something blocked its path, and/or the drawer was unable to stop its travel until it reached its fully extended position, contacting whatever was in its way. Likewise, prior art drawers often retracted into the wall or structure regardless of whether an item was fully inserted or removed from the drawer. As a result, transaction drawer structures and applications tended to be deficient in practical solutions to various concerns of reliability, safety, and liability.

Extensive controls and limit switches, typically of an electronic nature, were also necessary to make standard AC powered transactional drawers more reliable and practical in operation. As these control devices were added to already complicated and large assemblies, the transactional drawers tended to become even larger, more complicated and more expensive than their predecessors. Electronic limiting devices have a further disadvantage when used with sliding type drive arrangements (e.g. worm gears, threaded rods and the like) because the power reflected back to the power source is at the inverse of the square of the mechanical advantage. Ultimately, this makes it very difficult to sense the mechanical force electronically by sampling the armature current without excessive variance in the limit control.

When limit switches are utilized, they have a significant amount of variance in when they trip. Likewise, the amount of coast that is in the drive mechanics of prior drawers varies greatly. For instance, when the ambient temperature is high, the drive mechanisms for prior drawers would operate more freely, i.e. at a higher speed and with more inertia, thus the drawers coasted further putting more stress on the physical limits. Conversely, when the ambient temperature is low the drive mechanisms of prior drawers would typically operate tighter, at lower speeds and with less inertia. Thus, at low temperatures, prior drawers tended to coast shorter distances resulting in the drawer not opening fully or not closing fully. This condition can result in gaps and/or air leaks requiring seasonal adjustment of the limits.

Drive systems used to reciprocate transaction drawers, e.g. belts, pulleys, drive chains and other mechanisms have similarly been large, complicated, prone to premature wear and generally expensive to manufacture. Furthermore, the space required for prior transactional drawers and their drive systems was considerable and required a relatively large opening be cut in the side of the building, reducing the thermal efficiency of the building and reducing the security of the building as well. Further, transactional drawers have been prone to failure for extremely simple mechanical causes. For instance, most transactional drawers were reciprocated on ball bearing guides which are easily clogged and rendered inoperative by stray paper clips, rubber bands or even an errant envelope.

A further problem with prior devices has been that the customer door, which typically opens when the drawer has been extended outwardly, is hinged to the wall or the drawer itself. While some transaction drawers can be provided without moveable doors, generally, it is desirable to provide a pivoted door which opens outwardly as the drawer reaches its extended position. It is extremely important for all interior to exterior transactional drawers that they be sealed in some manner when they are in the closed position, in order to minimize thermal loss and extraneous noise. It is also beneficial to have a seal which prevents water, snow, wind and other environmental factors from entering the closed drawer. In this regard, heretofore, there has not been available a transactional drawer with a pivoted door which can be reliably repeatably, and uniformly sealed when moved to closed position.

Doors which are hinged, however, generally exert multi-directional forces on the sealing material as they are opened and closed. The most common gasketing material known to effectively withstand the repeated multi-directional forces exerted by a door opening in a hinged manner were brush type seals. Unfortunately, brush seals are notoriously poor gasketing material. Not only are thermal losses significant through brush seals, but air, water, and snow can also penetrate a typical brush seal.

Consequently, there has been a continuing need for a relatively small, inexpensive, relatively uncomplicated, easy to install, and intrinsically reliable and predictable transactional drawer. Clearly, prior devices teach drawers that mechanically reciprocate into and out of a building or other structure, but these prior devices have used complicated, expensive and relatively unreliable methods of operation both in reciprocating the drawer and in the opening and closing of the customer door. Thus, there is a need for a structure and method that allows the customer door to be opened in a manner that the seal is subjected to a force in only one direction when it is opened and/or closed, thus allowing the use of a multitude of gasketing materials which cannot be used in a standard hinged door. Furthermore, there is a need for a drawer which does not require expensive and complicated electrical limiting devices which are prone to failure.

SUMMARY OF THE INVENTION

It is the primary object of this invention to provide an improved transactional drawer and method of reciprocating a drawer relative to its housing.

It is the further object of this invention to provide a method of opening the door to the transactional drawer in a sequential, multi-stage manner.

It is also an object of the present invention to provide a transactional drawer which is intrinsically reliable and predictable, while minimizing, if not eliminating, the need for electronic limiting switches and/or devices.

It is yet another object of the present invention to provide an improved transaction drawer with a customer door opening and closing mechanism which minimizes the wear and tear on the door seal member, thereby enhancing the performance and longevity of the seal arrangement in repetitive use.

It is an object of the present invention to provide a transactional drawer which is inexpensive, easy to manufacture, easy to maintain, easy to install, has few parts, and provides all of the service functions that a larger, more expensive and more complicated transaction drawer provides.

It is also an object of the present invention to provide a transactional drawer which can be limited in its forward and reverse travel by mechanical means and to provide a low powered reversible power source that allows the mechanical stops to be contacted while the power source is still operating without internally damaging the reversible power source.

It is another object of the present invention to provide a transactional drawer which does not run on ball bearing guides, thus minimizing, if not eliminating, the risk of jamming the guide rails and thereby stopping the travel of the transactional drawer.

It is yet another object of the present invention to provide a door that, in the first stage of a sequential multi-stage process, moves in a direction substantially normal to the door seal seat. This first stage of the sequential opening thereby moves the door in a direction only normal to the sealing material and seat around the drawer so that the sealing material is stressed in only one direction (i.e. compression vs. no compression) as the door is opened and closed. This not only enhances the resulting seal and extends the life of the sealing material significantly; it allows for the use of a variety of different sealing materials which are not functional with hinged doors.

In accordance with one aspect of this invention, there is provided a transactional drawer assembly which consists of a housing, a drawer and an associated customer door having predetermined opened and closed positions. A low-powered reversible power source is provided to selectively reciprocate the drawer relative to the housing. The customer door is mechanically closed or opened in a sequential multi-stage manner due to the selective reciprocation of the drawer with respect to the housing.

In another preferred embodiment of the present invention, the low-powered reversible power source is a DC motor which drives a threaded rod. The threaded rod runs through a nut which is attached to the underside of the transactional drawer. The DC motor is capable of stalling when the transactional drawer contacts a mechanical stop at the drawer's fully-opened or fully-closed position. The low-powered DC motor is not damaged internally when it stalls in this manner. There is further provided a cam actuator and a cam follower that operate to open and close the customer door in a sequential multi-stage manner. The cam actuator is provided with more than one surface, with at least one surface being essentially parallel to the direction of travel of the reciprocating drawer. It is this essentially parallel surface that provides the substantially normal directional opening and closing of the customer door. The cam follower is attached to the drawer housing, while the actuator cam is rigidly attached to the door and rotatably attached to the drawer.

BRIEF DESCRIPTION OF THE DRAWINGS

While the specification concludes with claims particularly pointing out and distinctly claiming the present invention, it is believed that the same will be better understood from the following description taken in conjunction with the accompanying drawings in which:

DETAILED DESCRIPTION OF THE INVENTION

Figure 1:
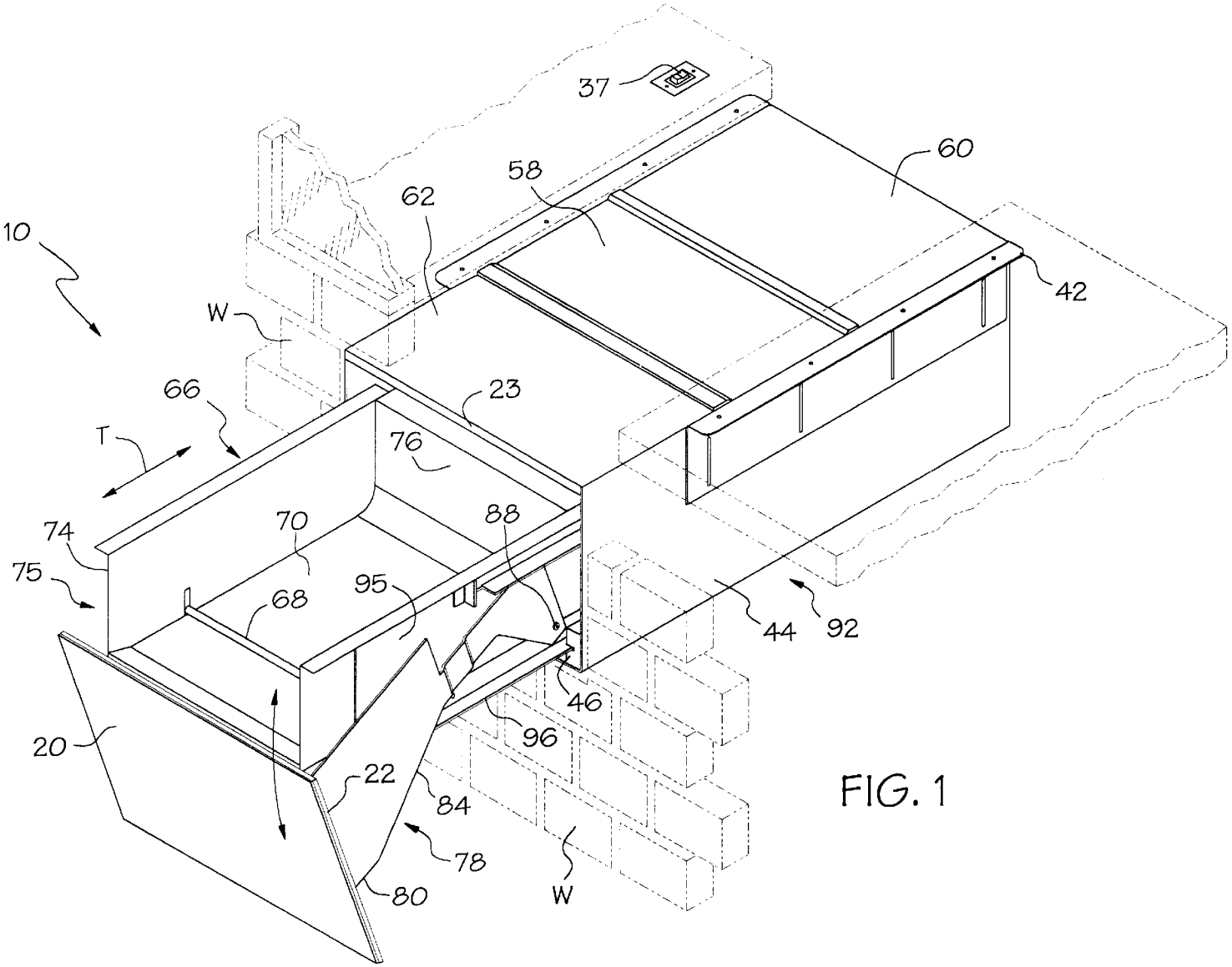
FIG. 1 is a partial perspective view of an exemplary transaction drawer assembly made in accordance with the present invention, shown as mounted in a brick wall and in its opened position.

Referring now to the drawings in detail, wherein like numerals indicate the same elements throughout the views, and wherein elements having the same final two digits (e.g., 12, 112, 212) indicate comparable elements of various preferred embodiments, FIG. 1 illustrates an exemplary transaction drawer assembly 10 made in accordance with one aspect of the present invention. The transaction drawer 66 is shown in its predetermined extended position with its door 20 in opened position, and a brick wall is shown to identify the environment (e.g. the exterior wall of a business) in which such transaction drawers are commonly used and mounted.

Figure 2:
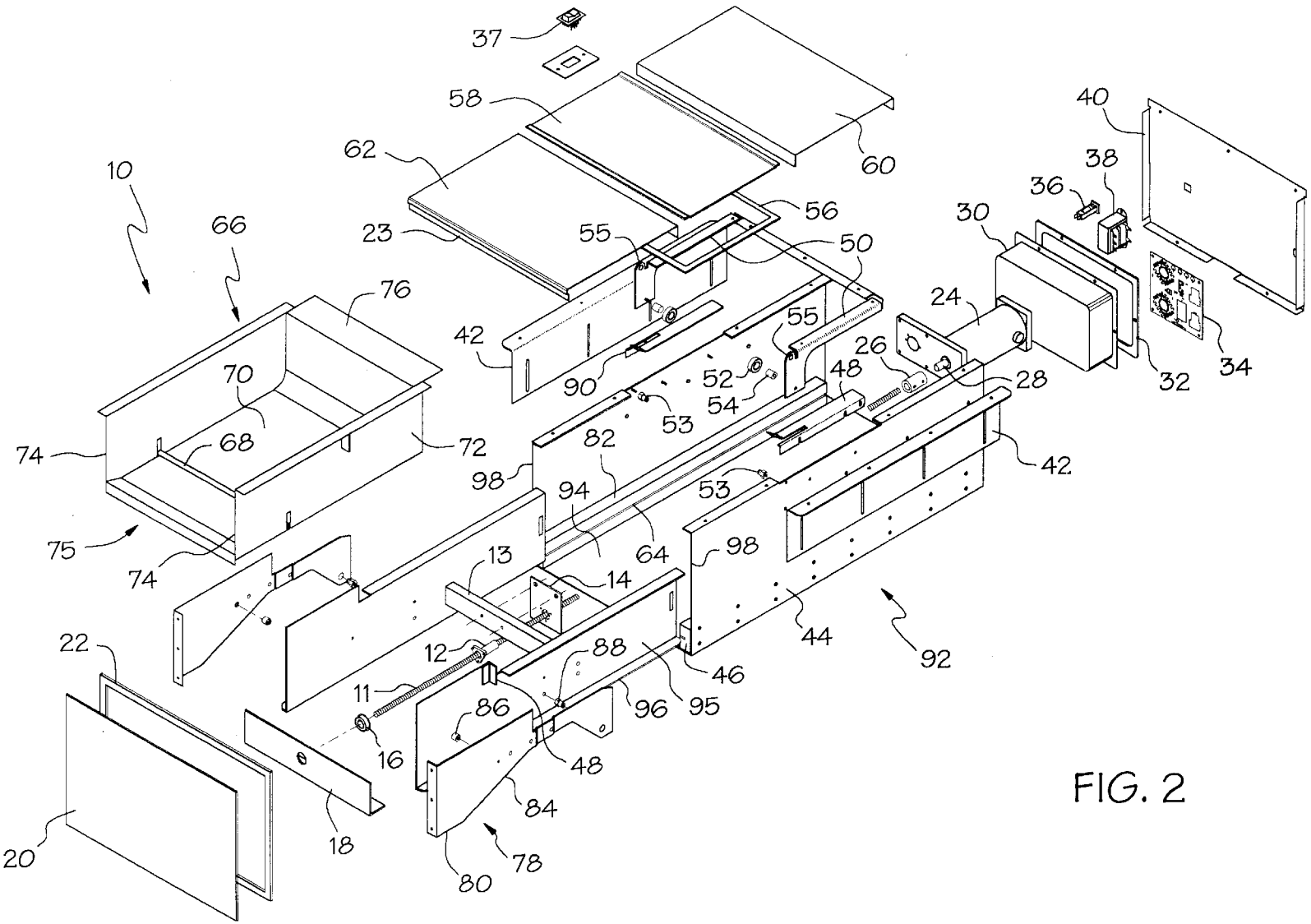
FIG. 2 is an exploded view of the transaction drawer assembly of FIG. 1.

FIG. 2 illustrates an exploded view of the transactional drawer assembly 10 from FIG. 1. Assembly 10 is shown as including a drawer 66, a customer door 20, a housing 92, and a reversible power source 24. The drawer 66 comprises two sides 72, a rear portion 76, a bottom 70, and a front edge 74 which defmes a front opening 75. In a preferred embodiment as shown in FIGS. 1 and 2, drawer 66 further comprises a bill trap bar 68 for use in monetary transaction applications and the like, and which can help to hold small items in place while the drawer 66 is reciprocated.

The customer door 20 is preferably provided with a seal member 22 near its periphery. Seal member 22 is preferably located between door 20 and front edge 74, and will generally be mounted so that it is in sealing contact with a seat 23, as shown in FIGS. 3 and 4 along at least a portion of housing 92 when door 20 is in its fully closed position, as will be discussed in greater detail below.

In one preferred embodiment, cam actuator arms 78 are attached to the customer door 20, and to the drawer side with an actuator cam pivot pin 88. In the embodiment shown in FIGS. 1 and 2, drawer side panels 95 are provided as additional pieces attached to the respective drawer sides 72, and drawer side panels 95 provide the side rails 96 which are discussed in greater detail below. As will be understood, drawer side panels 95 are not required to be separate, and cam actuator 78 could easily be attached directly to drawer side 72 with pivot pin 88. In a preferred embodiment, two cam actuators 78 are used for additional support of drawer 66 in conjunction with opposite side panels 95. As will be discussed in greater detail below, drawer 66 is easily manufactured by cutting and bending a single sheet of material if the side rails 96 are provided as separate pieces. While certainly possible, making drawer 66 and its side rails 96 from a single piece of material is generally a more time consuming and expensive manufacturing process and less preferred.

There is further provided an actuator cam limit pin 86 which limits the rotational movement of actuator cam 78 in a downward direction. When actuator cam 78 and attached door 20 pivot downward to its opened position, cam limit pin 86 restricts the door movement to a predetermined opened position (see FIGS. 1 and 3). When limit pin 86 reaches drawer guide rail 96, cam limit pin 86 stops the travel of door 20 and thereby defmes the "opened position" thereof. Cam actuator 78 rotates about a pivot pin 88 which can be provided as a bushing of long lasting material such as brass, although a bearing arrangement is equally acceptable.

Figure 3:
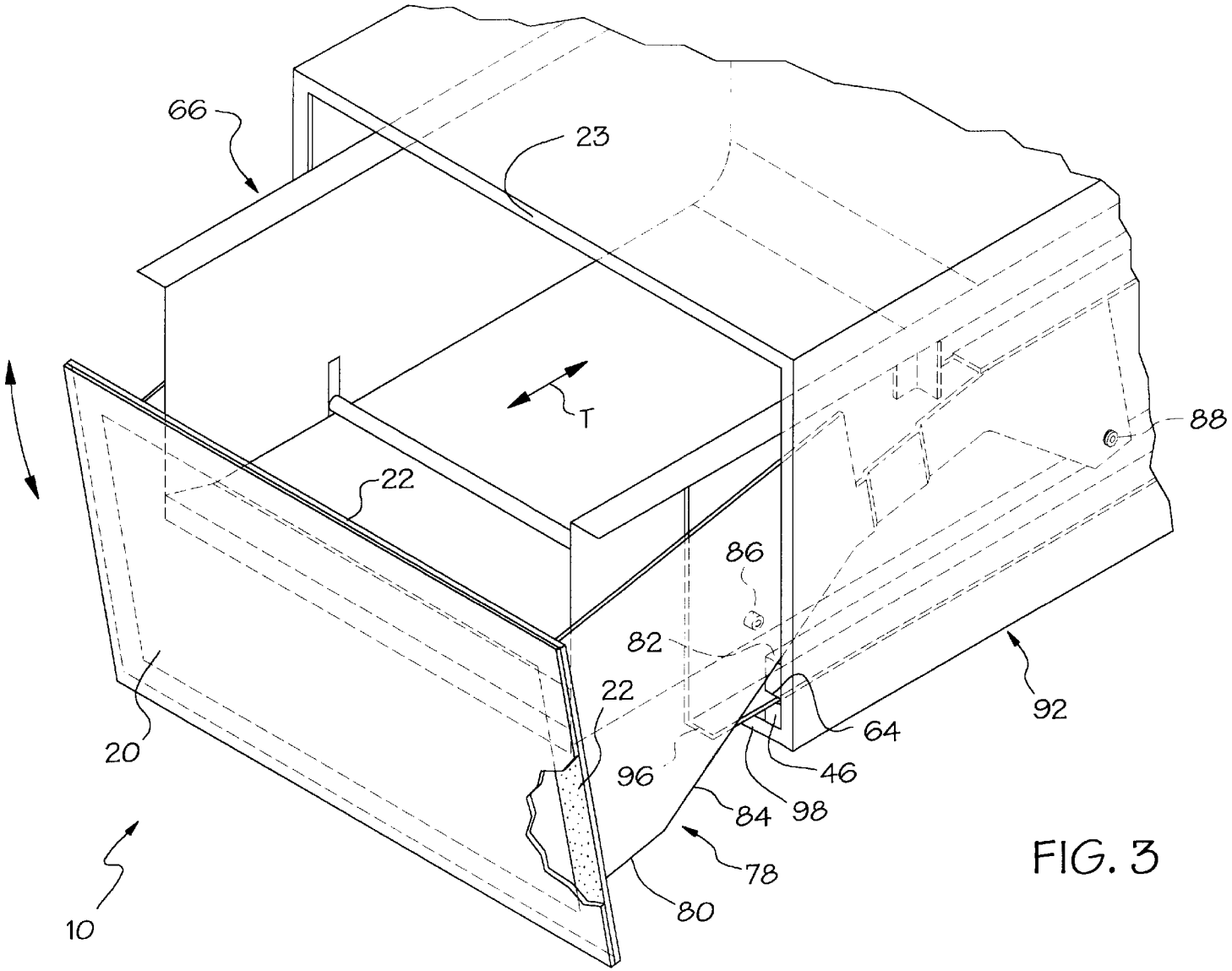
FIG. 3 is an enlarged, partial perspective side view of a transaction drawer assembly made in accordance with the present invention, illustrated in its partially opened position.
Figure 4:
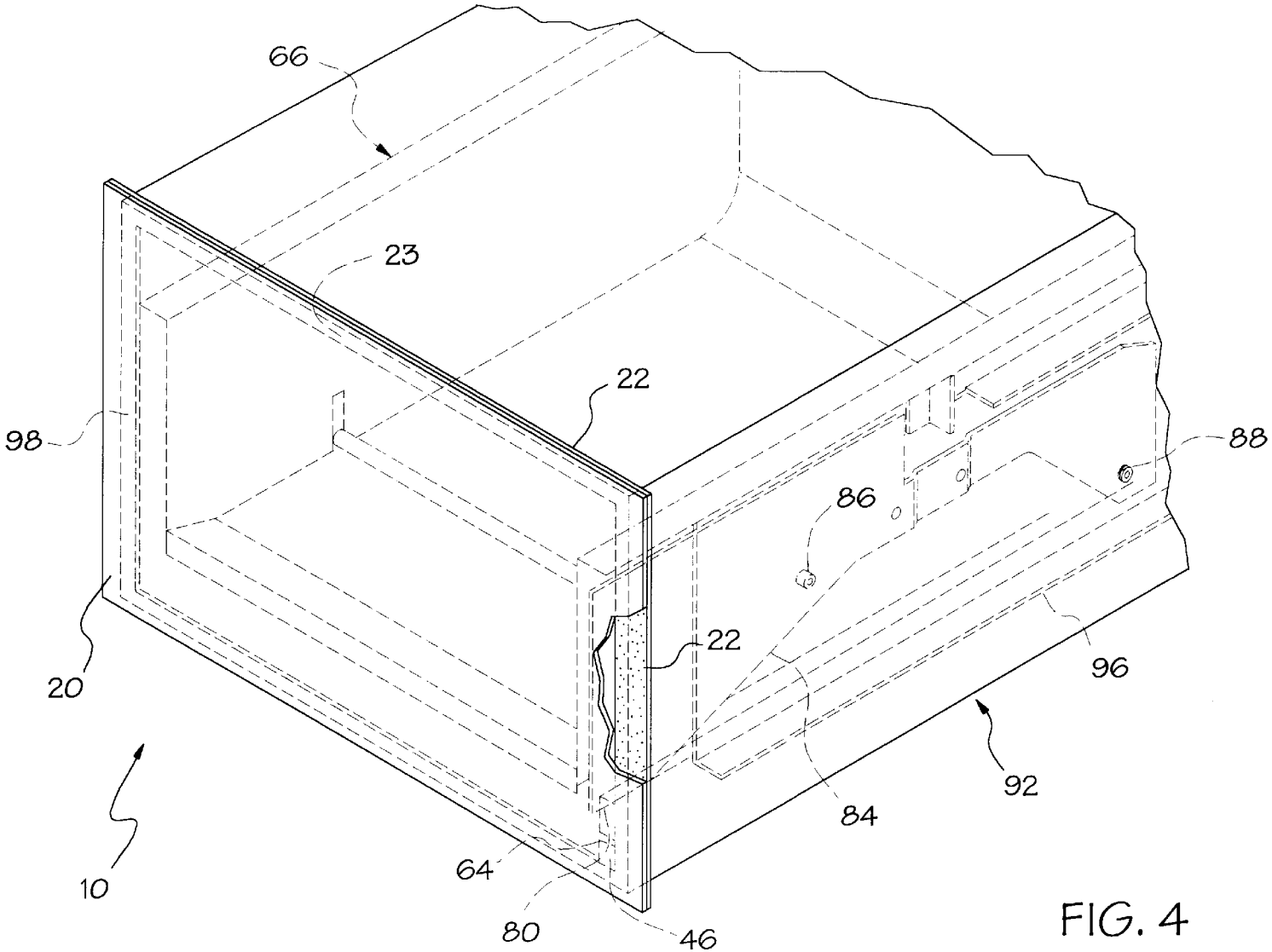
FIG. 4 is an enlarged, partial perspective side view of a transaction drawer assembly made in accordance with the present invention, illustrated in its closed position.

As is shown in FIGS. 3 and 4, drawer guide rail 96 serves the additional function of communicating with a slot 64 in guide track 46 which, in a preferred arrangement, is attached to drawer housing side member 44 near its lower portions. The interaction between guide rail 96 and guide slot 64 of guide track 46 guide drawer 66 as it is reciprocated into and out of housing 92. As discussed above, guide rail 96 can be formed into, i.e., as an integral portion of, drawer 66 or it can be provided as a part of the side panel 95 as shown in FIG. 2. As should also be highlighted, any guide track and rail arrangement or the like can be provided to facilitate the reciprocation between drawer 66 and its housing 92. Similarly, it is not critical, where a guide track and rail, per se, are used, whether the track or rail is attached to the drawer itself, as the specific application may dictate any of a variety of arrangements.

Drawer 66 and drawer side panels 95 can be manufactured by a variety of processes and from a variety of materials. Standard carbon steel, stainless steel, aluminum and the like are all suitable materials for the drawer and its side members, as well as the door 20 and cam actuator 78. Rigid plastic, fiberglass and other materials are suitable for construction of the drawer 66, customer door 20, cam actuator 78, and side rails 95. Sufficient rigidity is required for the resulting structures to perform their intended function, however, there are a multitude of materials and structural arrangements which can be appropriately selected to provide the strength and rigidity necessary to manufacture these parts. In a preferred embodiment, drawer 66 might be made from a single sheet of 16 gauge steel that is cut and bent into the appropriate drawer configuration. Likewise, the side members 95, customer door 20, actuator cam 78, and housing 92 can be cut and bent from standard 16 gauge steel.

Guide tracks 46 are preferably manufactured from a lightweight, durable and self-lubricating plastic such as Delrin® or other ultra high molecular weight polyethylene. Especially preferred materials are ultra high molecular weight materials that incorporate carbon, graphite or the like. The incorporation of carbon, graphite and the like serves to both reduce friction and to make the material slightly conductive. A slightly conductive guide rail can help discharge static electricity which, in conventional bearing guides, is discharged through the lubricant to the balls. Discharging static electricity in bearing guides can result in vaporization of the lubricant, which can cause premature wear and/or failure of the bearing guide.

Guide tracks 46 are typically machined from a single piece of plastic which is cut to size with a groove 64 machined therein. Guide rail 96 and guide track 46 should be provided of materials that can slidably interact compatibly so that guide rails 96 slide freely within groove 64 in guide tracks 46. As discussed above, a hard plastic material is preferred for these parts in order to reduce the coefficient of friction between guide track 46 and guide rail 96 in use, and the use of plastic can reduce the generation of static electricity as well. When the upper surface 82 of the guide track 46 is used as the cam follower, friction is further reduced and less static electricity is generated between cam 78 and its follower.

As is depicted in FIGS. 3 and 4, drawer 66 is reciprocated into and out of drawer housing 92, with its movement being limited by mechanical means. For instance, when drawer 66 is reciprocated into housing 92, customer door 20, and more precisely, customer door seal member 22 contacts the outer edge 98 of drawer housing 92 and is compressed between at least a portion of the edges of door 20 and outer edge 98 of the drawer (or other seat provided for the seal arrangement)

to create a seal therebetween. When door 20 has fully contacted the outer edge 98, drawer 66 can move no further into drawer housing 92 and its reciprocating travel will be stopped as the seal is drawn tight. In this way, housing 92 actually provides a positive mechanical stop for the drawer reciprocation in the inward direction and insures that the seal is optimized each time in the door's "closed" position. As is discussed in greater detail below, the use of simple mechanical stops allows the drawer 66 to dependably and repeatably pull up against door seal 22.

A mechanical stop for the outward travel of drawer 66 from housing 92 is also preferably provided. In the embodiment shown in FIG. 2, for example, drawer 66 is reciprocated via a threaded rod 11, one end of which runs through a bearing 16 secured in a bracket 18 attached to drawer housing 92. Threaded rod 11 further runs through a nut 12 attached to a bracket 14, on drive mount cross bar 13, which can be attached to drawer 66, such as adjacent its rear wall 76 or bottom 70. Threaded rod 11 is attached at its other end to the drive shaft 28 of power source 24 by a drive coupling 26, the interaction of power source 24 driving threaded rod 11, in a reversible manner causes nut 12 to reciprocate drawer 66 along the length of threaded rod 11 relative to housing 92. When nut 12 contacts bracket 18 and/or bearing 16, a second mechanical stop is provided to limit the outward travel of drawer 66 relative to housing 92. A "split collar" (not shown) can be provided which, when affixed on threaded rod 11 ahead of nut 12, limits the forward travel of drawer 66, thus, making the predetermined opened position of drawer 66 easily adjustable. FIG. 1 illustrates a preferred fully "opened position" of drawer 66 and its door 20 relative to housing 92.

As will be appreciated, power source 24 is preferably a low powered reversible power source which is capable of stalling without causing internal damage to itself when a mechanical stop, e.g. bracket 18 and/or bearing 16, is reached. The benefit of having a power source capable of stalling without creating internal damage allows for the effective elimination of a need for electronic limiting and switching devices, which can be a significant financial and mechanical savings which also makes drawer assembly 10 significantly less complicated. Furthermore, using a low powered reversible power source provides the additional benefit of rendering the drawer assembly 10 intrinsically reliable, predictable, and virtually incapable of injuring person or property in operation. If, for instance, a person or car is too close to drawer 66 when it is being reciprocated outwardly, drawer 66 will simply stall when contacting the object or person in its path.

In a preferred embodiment, low powered reversible power source 24 operates at approximately thirty to forty five pounds of force (approximately 130 to 200 Newtons) and drawer 66 travels approximately in the range of twenty five to thirty five feet per minute (approximately 7.5 to 10.5 meters per minute). In a preferred embodiment power source 24 is electronically limited in conjunction with a circuit panel 34. At normal operating speed and force, power source 24 receives 32 volts DC at 0.7 amps. When power source 24 is loaded to approximately 1.2 amps circuit panel 34 reduces the voltage to limit the current to a pre-set maximum limit, causing the voltage to drop to as low as 8 volts, at which point power source 24 stalls.

At forty lbs. of force (180 Newtons) and thirty feet per minute (9 meters per minute), reciprocating drawer 66 can be easily stopped with the human hand. Likewise, when drawer 66 is being reciprocated inwardly, an object caught in drawer 66 or door 20 will stall power source 24 and stop drawer 66 with minimal force. Although not shown, an additional benefit of the lower power requirements allows for two twelve volt lantern batteries to be supplied to act as a back-up power source in the event of a power failure.

In a preferred embodiment shown in FIG. 2, a forward/reverse/off switch 37 is shown in electrical communication with a control housing 30 along with circuit panel 34 a step down transformer 38 and a circuit breaker 36. Control housing 30 is sealed with a sealing member 32 which contacts rear panel 40 of drawer housing 92. The three position switch 37 is normally in the "off" position and can be provided as a spring loaded switch which requires the operator to hold the switch in one of two positions to reciprocate drawer 66 in a forward or reverse direction. Switch 37 automatically returns to the off position when operator pressure is released.

Threaded rod 11 can be of a variety of configurations, for example, a rod with ball form threads which communicates with a ball form nut, or threaded rod 11 can be a simple all thread rod communicating with a standard nut. Likewise, nut 12 can be any device that translates the rotational movement of threaded rod 11 into the reciprocating motion of drawer 66. In a preferred embodiment a high helix threaded rod is used with 0.5 inch (1.27 cm) of linear motion per revolution by virtue of its four pitch two start configuration.

Although a threaded rod/nut assembly is shown, the drive train can also be provided in other formats, such as worm gears, a system of cables and pulleys, or the like. As will become apparent, the drive train can be any of a variety of suitable mechanical means which translate motion from power source 24 to reciprocate drawer 66 into and out of housing 92, and which allow the simplified mechanical stop and sealing arrangement to be reliably accomplished with relatively low power. An optional manual operation handle (not shown) can be provided to reciprocate drawer 66 inwardly and outwardly in the event of a power failure. Manual operation is best achieved by disconnecting the motor armature windings (not shown) from the circuit panel 34 before engaging the manual handle. Disconnecting the windings eliminates the dynamic electrical braking action of power source 24 allowing for less force to be used during manual operation of drawer 66.

Drawer housing 92 is shown in FIGS. 1 and 2, with optional adjustable mounting brackets 42, which are preferably configured to the environment in which the transactional drawer assembly 10 will be installed. Transactional drawer assembly 10, shown in FIGS. 1 and 2, is further shown with an operator access door 58, commonly known as the "teller door". Also shown are a teller door seal member 56 and a teller door bracket 50 pivotally connected at connector holes 55 with pins 53 to side wall 44 of drawer housing 92. Teller door bracket 50 can be fixably connected to teller door 58 and teller door 58 is hingedly connected to front drawer housing cover 62. A rear drawer housing cover 60 is also provided in a preferred embodiment to maintain the integrity of the drawer housing 92.

Teller door guides 48 are shown as being fixably connected to drawer side wall 95, and they urge bracket 50 in an upward manner when teller door guides 48 contact bearings 52. Bearings 52 are attached to bracket 50 with bearing pins 54. The interaction of teller door guides 48 and bearings 52, as drawer 66 is reciprocated into drawer housing 92, causes teller door 58 to open in an upward manner exposing the interior of drawer 66. Teller door locking members 90 extend over the top of bearings 52 when drawer 66 is in the extended position. Thus the movement of bracket 50 is restricted which ultimately locks teller door 58 in its closed position when drawer 66 in its extended position.

As will be understood, there are a variety of ways, both mechanical and manual, to gain access to drawer 66 when it has been reciprocated into drawer housing 92. The system of a teller door 58 hingedly connected to a front housing cover 62 represents only one preferred method of gaining such access. For example, if any of the three top panels 62, 58, and 60 were simply omitted, there would be an opening whereby the drawer 66 would be exposed when in its fully closed position.

The preferred design of the drawer housing 92 includes two side walls 44, a bottom 94, a rear panel 40, and top panels (58, 60, and 62 in the preferred embodiment shown in FIG. 2) which define an essentially monocoque structure. The shown monocoque design requires no bulky and expensive frame or additional support structure because the rigid walls of housing 92 provide the necessary support for drawer 66 and its associated drive train and door 20. The self supporting monocoque structure is lightweight, easy to design and inexpensive to manufacture.

As was the case with the drawer parts described above, the drawer housing 92 can be manufactured from a variety of materials that are sufficiently rigid (either by themselves or as assembled) to support the drawer 66 and its associated components. In the preferred embodiment shown in FIG. 2, drawer housing sides 44 and drawer housing bottom 94 are cut and bent from a single sheet of metal (e.g. 11 gauge steel) which is sufficiently strong, yet lightweight, to support drawer 66 and its associated components. Likewise, top panels 62 and 60, teller door 58, and drawer housing rear panel 40 are all cut and bent from a single sheet metal product.

As will be apparent, in a preferred embodiment, (such as shown in FIGS. 3 and 4, of transaction drawer assembly 10), cam actuator 78 is provided with two cam actuator surfaces 80 and 84 which interact with a stationary cam follower in use. In a preferred embodiment the stationary cam follower is the upper surface 82 of guide track 46, although the cam follower can certainly be a separate structural member (not shown). The interaction of cam actuator surfaces 80 and 84 with the stationary cam follower 82 control the movement of customer door 20 relative to drawer housing 92.

The reciprocation of drawer 66 into drawer housing 92 from its extended position can best be seen in FIGS. 3 and 4. As first shown in FIG. 3, cam follower 82 remains substantially stationary so that it contacts the tapered surface or cam surface 84 of actuator 78 as drawer 66 is reciprocated relative to housing 92, causing actuator 78 to rotate in an upwardly direction about pivot pin 88, thereby moving door 20 upwardly from its fully "opened" position as drawer 66 moves inwardly. As shown in FIG. 3, door 20 moves in a generally rotating action upwardly until cam surface 80, which, in a preferred arrangement, is substantially parallel to the direction of travel (e.g. T) of the reciprocating drawer 66, contacts cam follower 82.

Thereafter, as depicted in FIG. 4, as the drawer continues to be reciprocated inwardly into its housing, customer door 20 follows cam surface 80 and is thereby moved in a direction substantially parallel to the direction of travel of drawer 66. Because door 20 is traveling in a single direction which is substantially parallel to the direction of travel as it is pulled into drawer housing 92, seal member 22 of customer door 20 is brought into contact with the outer edge 98 of drawer housing 92 in a single direction only. This uni-directional and substantially normal resulting contact between seal member 22 and the corresponding outer edge 98 (which might include a preformed seal "seat" to enhance the resulting seal) of drawer housing 92 limits the amount of non-normal stress placed on seal member 22. Consequently, it will be understood that the structure of the present invention insures that the door will be moved into and out of sealing contact with the seal member and the seat or edge 98 of housing 92 in only a substantially normal compressing or withdrawing direction relative thereto.

Likewise, when drawer 66 is being reciprocated outwardly from its retracted position as shown in FIG. 4, toward its extended position as shown in FIG. 3, the essentially parallel surface 80 rides along cam follower 82 causing customer door 20 and its associated seal member 92 to move in one direction only substantially normal and away from its closed and sealed position against the outer edge 98 of drawer housing 92. Once again, this uni-directional motion of the customer door 20 and its associated seal 22 as it moves away from the front edge 98 of drawer housing 92, significantly reduces the non-normal stress placed on seal member 22. This reduction in stress allows seal member 22 to be constructed from a variety of materials. Although brush seal material, cork or standard gasket materials can be used for seal member 22, it is more preferable to use a longer lasting material with superior sealing capabilities, such as an open cell sponge, soft foam material or a standard rubber gasketing material.

It should be clear that while a two stage cam actuator 78 is shown in the preferred embodiment, a variety of multi-stage configurations are possible. It is critical where a good seal is desired, however, that cam surface 80 for the seal/unseal portion of the door movement during a reciprocating stroke allows for the substantially only normal direction movement of the door, as shown in FIG. 4, when drawer 66 is first reciprocated outwardly from its closed and sealed position against housing 92, or when it is being reciprocated into final sealing or closed position relative to drawer housing 92. The remaining opening stages, controlled by surface 84 and/or other cam surfaces of cam actuator 78, are important for the operation of customer door 20 and its efficient and clear opening to expose the interior 75 of drawer 66. However, the additional stages are effectively isolated from the seal/unseal operation of the present drawer assembly and do not effect seal member 22. Therefore, there is far more flexibility in the design of surface 84 and other movement control surfaces of cam actuator 78.

Communication equipment is not shown but is typically installed with most transactional drawers. Although transactional drawer assembly 10 does not require communication systems to work properly, it is often necessary for a system of speakers and microphones to be provided allowing two-way communication to occur between the transactors on either side of the transactional drawer assembly. The communication equipment can be any number of combinations of commercially available audio and/or visual equipment, e.g., speakers, microphones, and/or cameras, placed on either or both sides of the drawer. The environment and type of transactions occurring will typically help dictate the type of equipment that is desired.

Having shown and described the preferred embodiments of the present invention, further adaptation of the transactional drawer assembly and method of reciprocating the drawer relative to said housing and method of opening and closing a customer door in a sequential multi-stage manner described herein can be accomplished by appropriate modifications by one of ordinary skill in the art without departing from the scope of the present invention. A number of alternatives and modifications have been described herein, and others will be apparent to those skilled in the art. For example, it has been mentioned that the multi-stage operation of the customer door could be varied as described so long as there is provided a stage which is effectively isolated in time and operation so that the customer door to be moved into and away from the outer edge of the drawer housing in a substantially only normal direction with respect to the door seal and seal seat adjacent the outer edge of the housing. Further examples of alternatives and modifications can be found in the design of the drive train and/or the threaded rod, which can be a variety of mechanical devices. Accordingly, the scope of the present invention should be considered in terms of the following claims, and is understood not to be limited to the details of the structures and methods shown and described in the specification in the drawings.

We claim:

1. A transactional drawer assembly comprising:

a housing having an outer edge;

a drawer having an associated customer door having a predetermined opened position and a closed and sealed position relative to said drawer, said drawer being reciprocable relative to said housing: and a cam actuator assembly for moving said door between said opened position and said closed and sealed position in response to reciprocation of said drawer relative to said housing, said actuator assembly further comprising a seal/unseal cam surface which interacts with cam follower to move said door between said closed and sealed position to an unsealed position in a substantially only normal direction with respect to said outer edge, and at least one other cam surface which interacts with a cam follower to move said door between said unsealed and opened positions in a direction which is not substantially normal to said outer edge; and wherein said door is rotatably mounted about a pivot point spaced from the front edge of the drawer; and with the assembly further comprising a threaded rod threadedly associated with a correspondingly threaded nut attached to said drawer, said threaded rod and nut assembly being powered by said low powered reversible power source for selectively reciprocating said drawer relative to said housing.

2. The assembly of claim 1, wherein said threaded rod is a ball form screw and said power source rotatably drives said rod.

3. A method of automatically reciprocating a transactional drawer and an associated customer door between predetermined opened and closed and sealed positions comprising the steps of:

providing a reciprocating transactional drawer assembly comprising:

a housing having an outer edge, a drawer having an associated customer door having a predetermined opened position and a closed and sealed position relative to said drawer, said drawer being reciprocable relative to said housing; and a cam actuator assembly for moving said door between said opened position and said closed and sealed position in response to reciprocation of said drawer relative to said housing, said actuator assembly comprising a cam follower seal/unseal cam surface which interacts with a cam follower to move said door between said closed and sealed position to an unsealed position in a substantially only normal direction with respect to said outer edge, and at least one other cam surface which interacts with the cam follower to move said door between said unsealed and opened positions in a direction which is not substantially normal to said outer edge;

providing a seal member between said customer door and at least a portion of said outer edge of said housing when said door is in said closed and sealed position;

reciprocating the drawer relative to the housing; and mechanically moving said customer door between said opened and closed and sealed positions in response to reciprocating movement of the drawer, whereby the door is always moved into and away from contact with said seal member in substantially normal direction relative thereto so that there are no substantial directional components other than in the normal direction.

4. The method of claim 3, herein the mechanical movement of said customer door comprises at least one separate sequential step of moving said door between said opened and unsealed positions in a second direction different from said substantially normal direction.

5. The method of claim 4, wherein said second direction of movement comprises rotation movement of said door relative to an axis transverse to said drawer.

6. The method of claim 3, wherein said mechanical movement of said customer door is induced by said seal/unseal cam surface and said at least one other cam surface interferingly interact with a single cam follower as the drawer is reciprocated.

7. The method of claim 4, wherein separate sequential steps of moving said door are provided by sequential interaction of said seal/unseal and other cam surfaces with a single cam follower in response to reciprocation of said drawer.

8. A power transactional drawer assembly comprising:

a housing having an outer edge;

a drawer and an associated customer door having predetermined opened and closed and sealed positions, said drawer being free to reciprocate relative to said housing;

a cam actuator assembly for moving said door between said opened position and said closed and sealed position in response to reciprocation of said drawer relative to said housing, said actuator assembly further comprising a seal/unseal cam surface which interacts with a cam follower to move said door between said closed and sealed position to an unsealed position in a substantially normal direction with respect to said outer edge, and at least one other cam surface which interacts with a cam follower to move said door between said unsealed and opened positions in a direction which is not substantially normal to said outer edge so that there are no substantial directional components in directions other than the normal direction;

at least one mechanical stop defining a predetermined limit to reciprocating movement of said drawer relative to said housing; and a low powered reversible power resource for selectively reciprocating said drawer relative to said housing, whereby when the drawer contacts a mechanical stop the drawer's reciprocating movement is physically stopped, and the power source stalls without causing internal damage.

9. A transactional drawer assembly comprising:

a housing having an outer edge;

a drawer having an associated customer door having a predetermined opened position and a closed and sealed position relative to said drawer, said drawer being reciprocable relative to said housing; and a cam actuator assembly for moving said door between said opened position and said closed and sealed position in response to reciprocation of said drawer relative to said housing, said actuator assembly comprising a cam follower, a seal/unseal cam surface which interacts with the cam follower to move said door between said closed and sealed position to an unsealed position in a substantially normal direction with respect to said outer edge so that there are no substantial directional components in directions other than the normal direction, and at least one other cam surface which interacts with the cam follower to move said door between said unsealed and opened positions in a direction which is not substantially normal to said outer edge.

10. The assembly of claim 9, further comprising at least two spaced mechanical stops for physically limiting the reciprocating movement of said drawer relative to said housing.

11. The assembly of claim 9, wherein said seal/unseal cam surface and said other cam surface are arranged so that only one cam surface can interact to operate the customer door at any given time and the movements of said door are sequential and effectively isolated from one another in operation and time.

12. The assembly of claim 9, wherein said seal/unseal cam surface and said other cam surface are provided on a single cam actuator.

13. The assembly of claim 12, further comprising a single cam follower which sequentially interacts with said respective seal/unseal and said other cam surface to move said door in effectively isolated stages.

14. The assembly of claim 9, further comprising a seal member located between said door and at least a portion of said outer edge when said door is in said closed and sealed position.

15. The assembly of claim 9, wherein said seal/unseal cam surface comprises a structure which is oriented essentially parallel to the direction of reciprocation of said drawer.

16. The assembly of claims 9, wherein said door is rotatably mounted about a pivot point spaced from the front edge of the drawer.

17. The assembly of claim 9, wherein the cam follower is located substantially stationary relative to said housing for sequential interaction with said seal/unseal and other cam surfaces in response to reciprocation of said drawer.

18. The assembly of claim 9, further comprising a low powered reversible power source for reciprocating said drawer relative to said housing.

19. A transactional drawer assembly comprising:

a housing having an outer edge;

a drawer having an associated customer door having a predetermined opened position and a closed and sealed position relative to said drawer, said drawer being reciprocable relative to said housing; and a cam actuator assembly for moving said door relative to said drawer and said housing, said actuator assembly comprising a seal/unseal cam surface, an other cam surface, and a cam follower, wherein, in a first stage, said cam follower contacts said seal/unseal cam surface so as to move said door between a closed and a sealed position to an unsealed position in a substantially normal direction with respect to said outer edge so that there are no substantial directional components in directions other than the normal direction, and in an additional stage said other cam surface moves said door between said unsealed and opened position in a direction which is not substantially normal to said outer edge, and wherein said seal/unseal and other cam surfaces are arranged so that only one cam surface can interact to operate said customer door at any given time and the movements of said door are sequential and effectively isolated from one another in time.

20. The assembly of claim 19, further comprising a seal member located between said customer door and at least a portion of said outer edge of said housing when said door is in said closed and sealed position.

21. The assembly of claim 19 wherein said seal/unseal cam surface and said other cam surface are provided on a single cam actuator.

22. The assembly of claim 21, wherein said cam actuator member is connected to said door and rotatably connected to said drawer, and said cam follower is connected to said housing.

23. The assembly of claim 19, wherein said seal/unseal cam surface comprises a structure which is oriented essentially parallel to the direction of reciprocation of said drawer.

24. The assembly of claim 19, wherein said seal/unseal and said other cam surface are provided on a unitary cam actuator, and the cam follower is provided to sequentially interact with both said cam surfaces in response to reciprocation of said drawer.

25. The assembly of claim 19, further comprising a low powered reversible power source for reciprocating said drawer relative to said housing.

26. A transactional drawer assembly comprising:

a housing including a sealing surface, with the housing defining an opening in a direction perpendicular to the sealing surface of the housing;

a drawer adapted so that at least a portion of the drawer can move into and out of the opening between a closed position, a first stage open position and a second stage open position; and a customer door including a sealing surface, with the customer door being moveable so that when the drawer is in the closed position the sealing surface of the housing and the sealing surface of the door are parallel and form a seal by contact therebetween;

when the drawer is moved between the closed position and the first stage open position, the door moves so that the sealing surface of the door moves in a direction normal to the sealing surface of the housing; and when the drawer is moved between the first stage open position and the second stage open position, the door moves so that the sealing surface of the door rotates relative to the sealing surface of the housing.

* * * * *